US006715534B1

(12) United States Patent
Kablov et al.

(10) Patent No.: US 6,715,534 B1
(45) Date of Patent: Apr. 6, 2004

(54) METHOD AND APPARATUS FOR PRODUCING DIRECTIONALLY SOLIDIFIED CASTINGS

(75) Inventors: Vegeny Nikolaevich Kablov, Moscow (RU); Viktor Vladimirovich Gerasimov, Moscow (RU); Joseph Markovich Demonis, Moscow (RU); Viatcheslav Alexeevitch Nikolaev, Moscow (RU); Elena Mikhailovna Visik, Moscow (RU)

(73) Assignees: All-Russian Scientific Research Institute of Aviation Materials, Moscow (RU); General Electric Company, Schenectady, NY (US)

( * ) Notice: Subject to any disclaimer, the term of this patent is extended or adjusted under 35 U.S.C. 154(b) by 0 days.

(21) Appl. No.: 09/319,906

(22) Filed: Jun. 14, 1999

Related U.S. Application Data

(63) Continuation of application No. PCT/US98/19021, filed on Sep. 14, 1998.

(30) Foreign Application Priority Data

Sep. 12, 1997 (RU) ..... 97115515

(51) Int. Cl.[7] ..... B22D 27/04

(52) U.S. Cl. ..... 164/122.1; 164/122.2; 164/61

(58) Field of Search ..... 164/122.1, 338.1, 164/61, 256, 122.2

(56) References Cited

U.S. PATENT DOCUMENTS 1,793,672 A * 2/1931 Bridgman ..... 164/122.2
3,700,023 A * 10/1972 Gramer et al. ..... 164/122.2
5,921,310 A * 7/1999 Kats et al. ..... 164/61

* cited by examiner

*Primary Examiner*—Tom Dunn
*Assistant Examiner*—I.-H. Lin
(74) *Attorney, Agent, or Firm*—Jay L. Chaskin; Cantor Colburn LLP

(57) ABSTRACT

The present invention relates to an apparatus for metal casting and can be used in producing castings with directional and single crystal structure. The apparatus comprises a vacuum chamber inside which there is disposed an induction melting furnace, a mold preheating furnace with a ceramic mold, and a water-cooled tank being shaped as a truncated cone having a bottom portion and an upper portion which is opened towards a heating zone. The heating zone and the cooling zone are separated by a baffle articulating in a horizontal plane and consisting of segments or sectors. The apparatus allows the production of high quality castings having the directional and single crystal structure including the large sized castings by both the method of radiation cooling and the method of liquid metal cooling. Said invention gives the possibility to use successively the disclosed apparatus as a mold catch basin in the event of mold breakage and to increase the reliability and economic profitability of the apparatus' performance.

15 Claims, 1 Drawing Sheet

METHOD AND APPARATUS FOR PRODUCING DIRECTIONALLY SOLIDIFIED CASTINGS

This is a continuation application of International Application No. PCT/US98/19021 filed Sep. 14, 1998.

FIELD OF THE INVENTION

The present invention relates to metal casting and can be used in producing castings with directional and single crystal structure. In particular the invention relates to a metal casting apparatus with a water-cooled tank having a truncated cone shape.

BACKGROUND OF THE INVENTION

An apparatus for directional solidification generally comprises a vacuum chamber inside which there are disposed a mold heating zone, a baffle system, a water-cooled chill plate usually made of copper, an induction furnace, and a thermocouple system that automatically controls and maintains the temperature in a cooling zone and in a heating zone within the furnace. Such features are disclosed in U.S. Pat. Nos. 3,680,625, 4,804,311, and 4,412,577.

Also known in the art is an apparatus for directional solidification, in which the cooling zone is a liquid cooling bath with a material that melts easily to serve the role of the cooling medium. The liquid metal bath is disclosed in U.S. Pat. Nos. 3,763,926 and 3,915,761, and Russian Federation Patent No. 2010672.

Apparatuses in which both types of the above mentioned assemblies are combined (i.e., the copper chill plate and the liquid metal cooling bath) are also known. But those apparatuses comprise two actuators for vertical transportation of a mold with a metal casting. These actuators are disposed above and beneath the vacuum chamber housing. For that reason the dimensions of the apparatuses are enlarged and the service of the installations become complicated while the reliability of the apparatuses is decreased (see U.S. Pat. No. 5,197,531, and the publication Singer R. F. "Directional and Single Crystal Solidification Using LMC").

The closest prior art to the embodiments of the present invention is an apparatus disclosed in French Patent Application 2604378. French Patent Application 2604378 discloses an apparatus comprising a vacuum chamber with a heating member inside where there is disposed a ceramic mold fixed on a water-cooled metallic plate which is moved up and down with the help of a rod and of an actuator for vertical transportation A horizontal baffle separates a heating zone and a cooling zone In the cooling zone concentrically with the chill plate, there is disposed an additional circular water-cooled cavity with the inner diameter exceeding the mold s maximal size. Below the cavity there is disposed a container that is utilized for capturing the poured casting metal in the event of mold breakage.

The above apparatuses, including the apparatus of French Patent Application 2604378, can function only when they comprise a crystallizer. It is impossible to use such installation for directional solidification processing with a liquid metal coolant and it is difficult to utilize the expensive alloys used in directional solidification castings in the event of mold breakage. Thus there is a need for a casting apparatus that provides a means that efficiently cools the molten cast alloy while protecting the equipment from damage in the event that the ceramic mold breaks while containing the molten cast alloy material.

SUMMARY OF THE INVENTION

The technical aim of this invention is to produce castings having the directional and single crystal structure by the method of radiation cooling without using the above-mentioned crystallizer. Another aim of the invention is to be able to reconstruct easily the invented apparatus for both radiation crystallization processing and liquid metal cooling crystallization processing. The inventive apparatus also increases the reliability and economic profit due to the apparatus' performance.

An embodiment of the apparatus comprises a vacuum chamber inside which there is disposed an induction melting furnace a mold preheating furnace with a ceramic mold, a drive assembly for mold transportation and a water-cooled tank. The drive assembly comprises a rod on which the mold is fixed with the help of a hanger and a regulating actuator for vertical movement being positioned above the vacuum chamber. The water-cooled tank is shaped as a truncated cone. The tank upper portion is opened towards the heating zone, and its bottom portion has a smaller base than the upper portion. A baffle separates the heating zone inside the induction furnace from the cooling zone. The baffle moves in a horizontal plane and closely adjoins the mold during the solidification process. The baffle consists of the segments or sectors (not less than 2 from each side).

DESCRIPTION OF THE INVENTION

Figure 1:
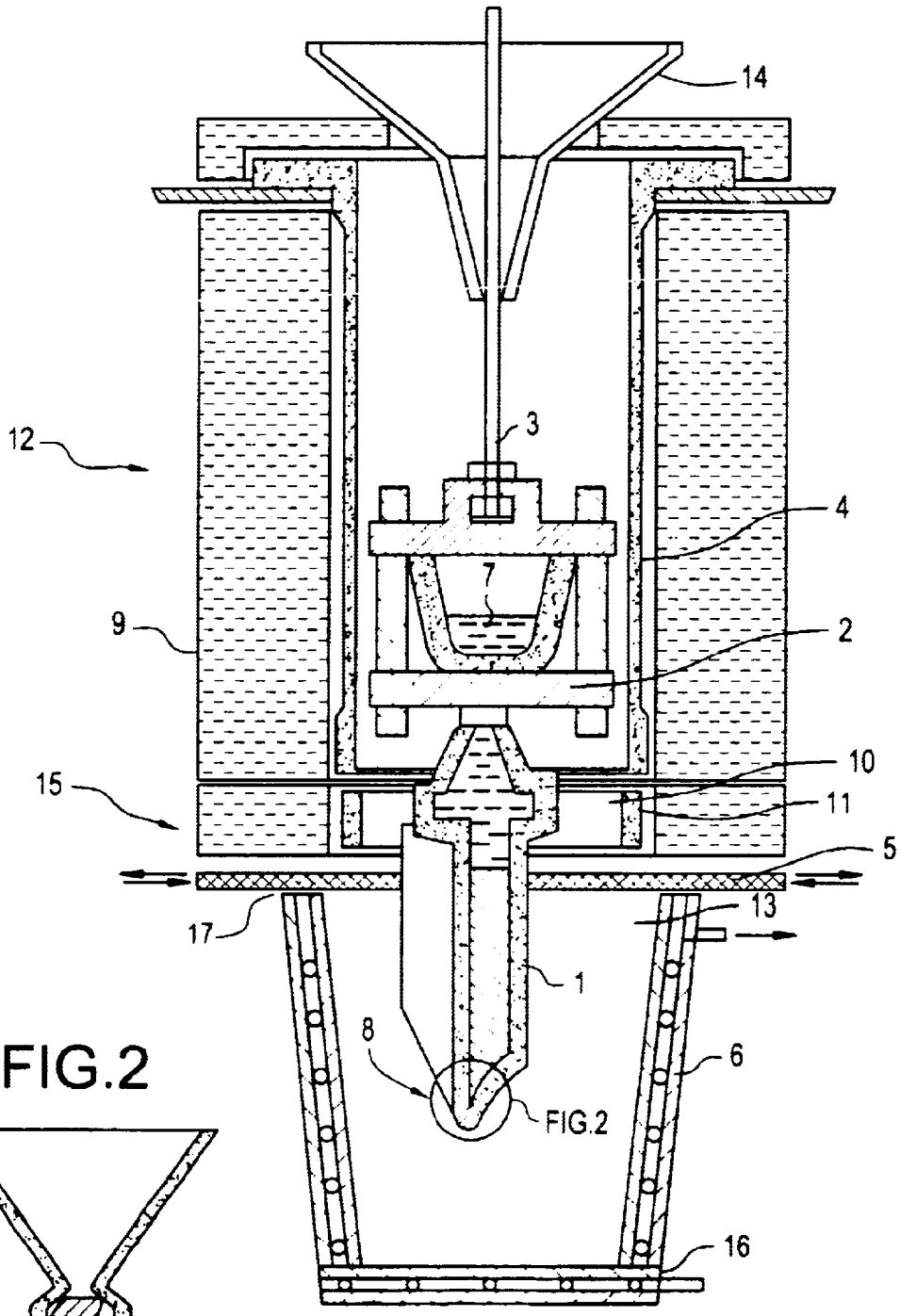
FIGS. 1 and 2 show a schematic drawing of the apparatus where 1 is a ceramic mold, 2 is a hanger to fix the mold to a drive a assembly, 3 is a rod, 4 is a heater of a mold preheating furnace, 5 is a heat baffle, 6 is a water-cooled tank, 7 is a molten superalloy, and 8 is a starting zone with a seed.
Figure 2:
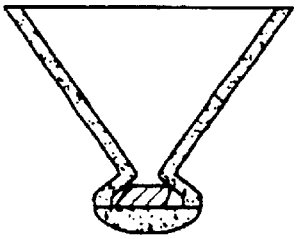

The apparatus performs as follows: the mold (1) is disposed on the hanger (2) and is fixed on the movable rod (3). The hanger (2), the movable rod (3), and the regulating actuator comprise the drive assembly (14). The mold (1) is placed into the mold preheater furnace (9) with the help of the actuator while regulating the mold position relative to the heater (4). The heat baffle (5) is disposed under the heating zone (10). The top butt end of the water-cooled tank (6) adjoins the baffle's (5) lower surface and is positioned coaxially with the heater (4) and (11). The vacuum chamber (12) is evacuated to $1\times10^{-3}$ mm m.c. The mold preheating furnace (9) is switched on. Upon reaching the mold temperature of 100–150° C. higher than the liquidus temperature of the alloy being cast, the induction furnace's heater (11) is switched on, the alloy (7) being cast melts and is poured into the heated ceramic mold at the predetermined temperature. After that, the actuator for vertical transportation lowers the mold from the heating zone (10) into the cooling zone (13) at the required rate. Solidification of the molten cast alloy occurs by radiation onto the cold walls of the water-cooled tank. Due to this fact it becomes possible to produce large sized castings with directional and single crystal microstructure. Large size castings can include blades, nozzles, buckets, airfoils, and the like, that are used both in aircraft and land-based turbine engines. The castings are often greater than 30 inches in overall height.

Once the mold with the casting alloy has been lowered along its complete height into the cooling zone, the heater (4 and 11) is switched off. When the temperature is decreased to 300–400° C., the mold with the solidified casting alloy is extracted from the installation which has been previously decompressed. Then the process is repeated for the next mold.

In another aspect of this invention, in order to produce blades having single crystal structure with desired orientation, a single crystal seed with proper orientation is positioned into the top of the starting zone (8) of the ceramic mold before it is disposed in the vacuum chamber. Then the mold position is strictly fixed relative to the heater. In such event the seed and the solidified portion of the starting zone serve as a cooling medium, and further solidification of the melt is caused by radiation cooling in the water-cooled tank as stated above. The use of the water-cooled tank instead of a chill plate allows the same or better working efficiency of the tank than that of a chill plate or of the circular water-cooled cavity. At the same time the water-cooled tank of this embodiment of the invention does not require the use of a complex drive assembly with airtight seals As stated above, the heat baffle (5) is used for raising the axial temperature gradient at the solidification front. Said baffle moves in a horizontal plane, closely adjoins the ceramic mold according to its geometry during the solidification process and consists of the segments or sectors (not less than 2 from each side).

In the inventive apparatus the water-cooled tank may be made of stainless steel and contain a double layer wall surrounding the perimeter of the tank. A vacuum atmosphere is created in the tank to further aid in the cooling of the cast parts. The tank may also effectively function as a mold catch basin in the event of mold breakage, and the expensive, poured casting alloy may be easily removed from the tapered tank and be remelted.

The embodiments of the apparatus and method of this invention allows one to produce high quality castings having the directional and single crystal structure, including the large sized castings used, for example, in the land based turbine industry, by the method of radiation cooling without using the crystallizers of the prior art. The embodiments of the invention also gives the possibility to reconstruct easily the disclosed apparatus for liquid metal cooling crystallization processing, to use successively the water-cooled tank as a mold catch basin in the event of mold breakage, and to increase the reliability and economic profitability of the apparatus performance One skilled in the art may make various modifications in the manner and/or structure and/or steps and/or way and/or function and equivalents thereof of the disclosed embodiments without departing from the scope and extent of the invention.

What is claimed:

1. A method of making a metal casting comprising the steps of:

a. placing a mold in a mold furnace having a heating zone;

b. heating the mold to a temperature of about 100 to 150° C. above a liquidus temperature of a casting alloy;

c. pouring a molten alloy into the heated mold;

d. lowering the mold with the molten alloy into a cooling zone comprising a tank having an open upper portion and a closed bottom portion with water-cooled walls extending therebetween, the open upper portion being immediately adjacent to the heating zone; and e. solidifying the molten alloy by radiation cooling onto the water-cooled wall of the tank to form the metal casting.

2. The method of claim 1 where the mold passes through a baffle located between the heating zone and the cooling zone.

3. The method of claim 1 wherein the tank has a truncated cross-sectional with the bottom portion having a smaller base than the upper portion.

4. The method of claim 1 wherein the mold has a starter cavity for a crystal having a defined crystal orientation.

5. The method of claim 1 wherein the tank has a double layer wall.

6. The method of claim 1 wherein the tank is made of stainless steel.

7. The method of claim 1 wherein the mold is made of a ceramic.

8. The method of claim 1 wherein the mold and the furnace are disposed in a vacuum chamber.

9. The method of claim 1 wherein the furnace comprises a preheating furnace and an induction furnace.

10. The method of claim 1 wherein the cooling zone is instead of a chill plate.

11. A method of making a metal cast in comprising the steps of:

a. placing a casting alloy into a furnace having a preheater in a vacuum chamber;

b. lowering the alloy into the preheating furnace;

c. evacuating the vacuum chamber;

d. heating the alloy to a temperature of about 100 to 150° C. above a liquidus temperature of the alloy to provide a molten alloy;

e. providing a heating furnace to heat a mold; the heating furnace having a heating zone;

f. pouring molten alloy into the heated mold;

g. disposing a baffle under the heating zone;

h. lowering the mold with the molten alloy into a cooling zone comprising a tank having an open upper portion and a closed bottom portion with water-cooled walls extending therebetweeem the open upper portion being immediately adjacent to the heating zone;

i. turning off the preheater and the furnace heater;

j. solidifying the molten alloy by radiation cooling onto the water-cooled wall of the tank until the temperature is decreased to 300–400° C.;

k. decompressing the vacuum chamber, and l. extracting the solidified metal casting.

12. The method of claim 11 wherein the mold has a starter cavity for a crystal having a defined crystal orientation.

13. The method of claim 11 wherein the tank has a truncated cross-sectional with the bottom portion having a smaller base than the upper portion.

14. The method of claim 13 wherein the mold has a starter cavity for a crystal having a defined crystal orientation.

15. The method of claim 11 wherein the cooling zone is instead of a chill plate.

* * * * *